US010534305B2

(12) United States Patent
Saito et al.

(10) Patent No.: US 10,534,305 B2
(45) Date of Patent: Jan. 14, 2020

(54) IMAGE FORMING APPARATUS AND NON-TRANSITORY RECORDING MEDIUM STORING COMPUTER READABLE PROGRAM

(71) Applicant: Konica Minolta, Inc., Chiyoda-ku, Tokyo (JP)

(72) Inventors: Hiroyuki Saito, Tokyo (JP); Tetsuya Ishikawa, Sagamihara (JP); Tomohiro Kawasaki, Sagamihara (JP); Tatsuya Furuta, Mitaka (JP); Ryoei Ikari, Tokorozawa (JP); Aiko Kubota, Hino (JP)

(73) Assignee: Konica Minolta, Inc., Chiyoda-ku, Tokyo (JP)

( * ) Notice: Subject to any disclaimer, the term of this patent is extended or adjusted under 35 U.S.C. 154(b) by 81 days.

(21) Appl. No.: 15/798,771

(22) Filed: Oct. 31, 2017

(65) Prior Publication Data

US 2018/0136582 A1 May 17, 2018

(30) Foreign Application Priority Data

Nov. 15, 2016 (JP) ..... 2016-222488

(51) Int. Cl.

| | |
|---|---|
| ***G03G 15/08*** | (2006.01) |
| ***G03G 15/00*** | (2006.01) |
| ***G03G 15/01*** | (2006.01) |

(52) U.S. Cl.

CPC ..... *G03G 15/6585* (2013.01); *G03G 15/0121* (2013.01); *G03G 15/0849* (2013.01); *G03G 15/0865* (2013.01); *G03G 15/50* (2013.01); *G03G 15/556* (2013.01)

(58) Field of Classification Search

CPC ..... G03G 15/6585; G03G 2215/0636

See application file for complete search history.

(56) References Cited

U.S. PATENT DOCUMENTS

| | | | | |
|---|---|---|---|---|
| 2013/0028619 | A1 | 1/2013 | Terao et al. | |
| 2014/0043625 | A1* | 2/2014 | Koyatsu | G06K 15/18 358/1.9 |
| 2016/0195829 | A1* | 7/2016 | Takahashi | G03G 9/0926 430/107.1 |

FOREIGN PATENT DOCUMENTS

| | | | |
|---|---|---|---|
| JP | 2012103535 A | * | 5/2012 |
| JP | 2013-025218 A | | 2/2013 |

* cited by examiner

*Primary Examiner* — Thomas S Giampaolo, II
(74) *Attorney, Agent, or Firm* — Buchanan Ingersoll & Rooney PC

(57) ABSTRACT

An image forming apparatus includes: an image former that forms a toner image based on input image information by superposing toners of plural colors on a recording material; a fixer that fixes the toner image formed on the recording material; a toner amount calculator that calculates, from the input image information, an amount of toners to be superposed on the recording material; and a hardware processor that controls the image former to supply an assistance toner that assists melting of the toners used for forming the toner image based on the input image information by an amount corresponding to the calculated amount of toners.

13 Claims, 5 Drawing Sheets

IMAGE FORMING APPARATUS AND NON-TRANSITORY RECORDING MEDIUM STORING COMPUTER READABLE PROGRAM

Japanese Patent Application No. 2016-222488 filed on Nov. 15, 2016, including description, claims, drawings, and abstract the entire disclosure is incorporated herein by reference in its entirety.

BACKGROUND

Technological Field

The present invention relates to an image forming apparatus and a non-transitory recording medium storing a computer readable program.

Description of the Related Art

In recent years, an image forming apparatus (copier, printer, facsimile machine, or multifunctional apparatus having these functions) of an electrophotographic system that forms a full-color toner image on a paper sheet uses toners of three primary colors of yellow (Y), magenta (M), and cyan (C) and a toner of black (K) to reproduce colors.

Conventionally, when forming an image of mixed color by using toners of Y, M, and C, the total amount of the toners of Y, M, and C may exceed a predetermined value. In this case, much energy is needed for fixing the toners onto a paper sheet in a fixing process. To address this, ensuring a sufficient fixing time by reducing the sheet conveyance speed can be considered. However, there is a problem that the productivity of printing decreases in this case.

Meanwhile, in order to retain the sheet conveyance speed without decreasing the productivity of printing, it is required to raise a fixing temperature, that is, a set temperature of a heat source such as a heater, in a fixing process. However, at this time, there is a problem that a fixing defect (hot offset) occurs due to a difference between heat absorbance of toners positioned closer to the heater and toners positioned farther from the heater.

In addition, in an image forming apparatus of an electrophotographic system, most of the power is consumed by a fixer, and thus reducing the power consumption of a fixing unit has been demanded accompanied by the demand for energy conservation of these years. In the case where the fixing temperature of the fixer is raised, the power consumption increases, and thus the demand for energy conservation cannot be met.

Due to such actual circumstances, there are some image forming apparatuses of electrophotographic systems that performs under color removal (UCR) to adjust the total amount of toner by reducing the amount of attached color toners of Y, M, and C. This process of UCR is performed by replacing a gray component formed from superposition of three primary colors of Y, M, and C by a black (K) component. By performing such a UCR process, the total amount of attached toner decreases. This contributes to improvement of fixability. However, in the case of performing a UCR process, an image that can be originally expressed by the three primary colors of Y, M, and C is expressed by additionally using K, and thus there is a problem that the depth of a black color and fineness of an image in a black background decrease when, for example, outputting a photographic image.

JP 2013-25218 A discloses a technique of estimating the amount of attached toner on the basis of input image information and thereby controlling the fixing temperature.

On the other hand, the technique disclosed in JP 2013-25218 A is configured to raise the fixing temperature in the case where the amount of attached toner is large, and such a method increases the consumption of thermal energy and cannot meet the demand for energy conservation described above.

SUMMARY

An object of the present invention is to provide an image forming apparatus and an image forming method that are capable of fixing a toner image with a small energy consumption while retaining the productivity and image quality.

To achieve the abovementioned object, according to an aspect of the present invention, an image forming apparatus reflecting one aspect of the present invention comprises:

an image former that forms a toner image based on input image information by superposing toners of plural colors on a recording material;

a fixer that fixes the toner image formed on the recording material;

a toner amount calculator that calculates, from the input image information, an amount of toners to be superposed on the recording material; and a hardware processor that controls the image former to supply an assistance toner that assists melting of the toners used for forming the toner image based on the input image information by an amount corresponding to the calculated amount of toners.

BRIEF DESCRIPTION OF THE DRAWING

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Hereinafter, one or more embodiments of the present invention will be described in detail with reference to the drawings. However, the scope of the invention is not limited to the disclosed embodiments.

Figure 1:
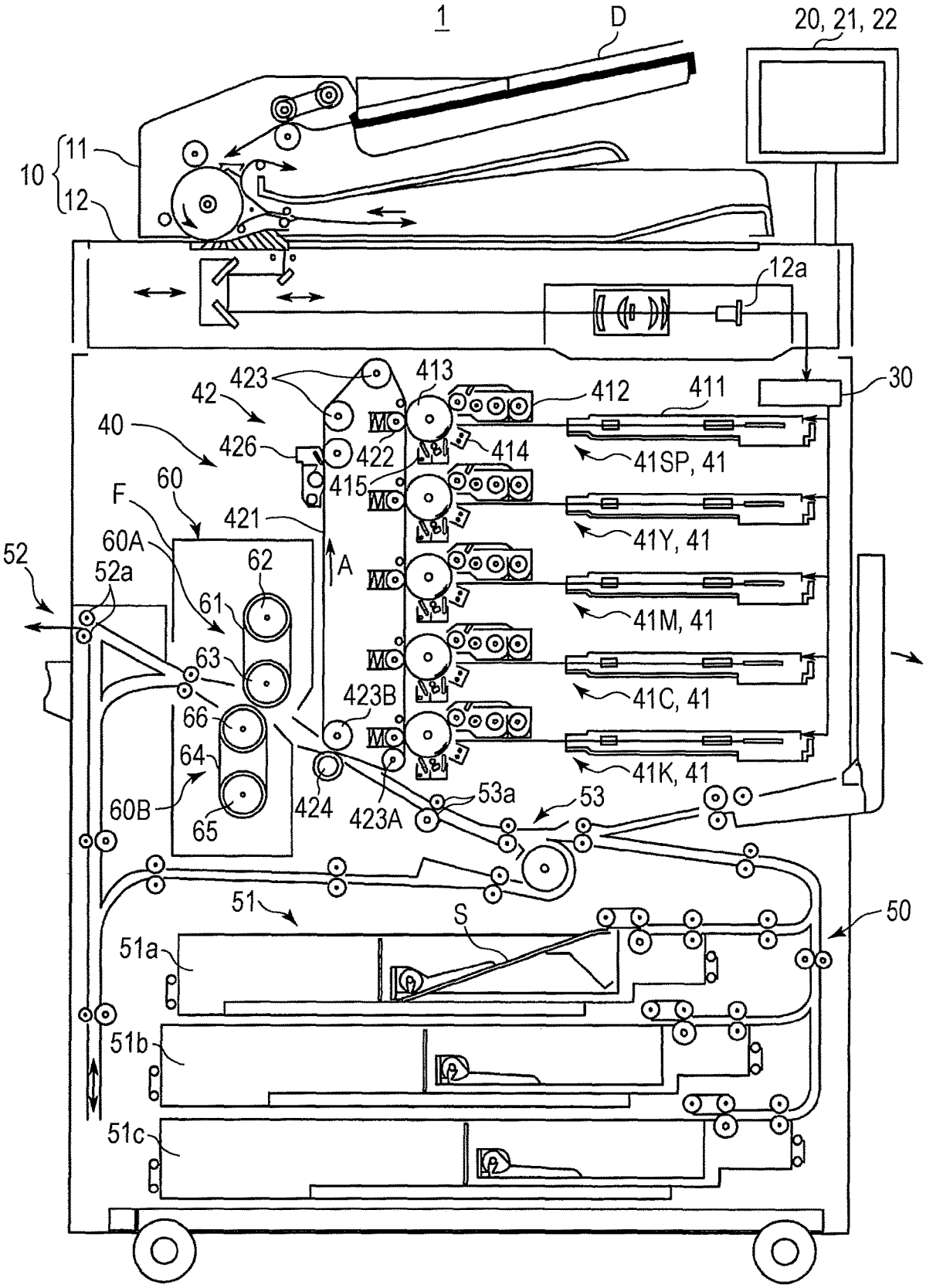
FIG. 1 schematically illustrates an overall configuration of an image forming apparatus according to an embodiment.
Figure 2:
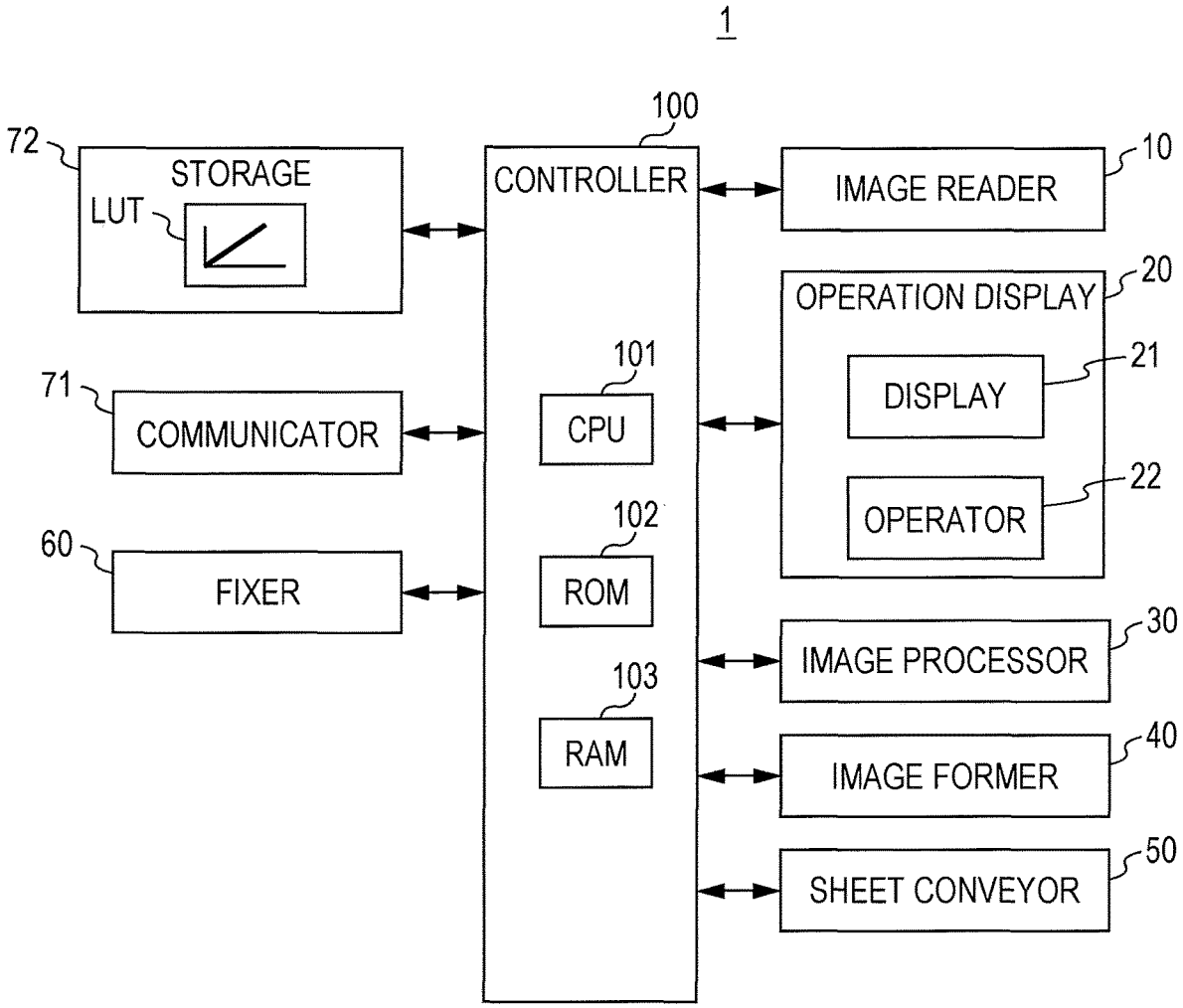
FIG. 2 illustrates a part of a control system of the image forming apparatus according to the embodiment.

FIG. 1 schematically illustrates an overall configuration of an image forming apparatus 1 according to an embodiment of the present invention. FIG. 2 illustrates a part of a control system of the image forming apparatus 1 according to the embodiment. The image forming apparatus 1 illustrated in FIGS. 1 and 2 is a color image forming apparatus of an intermediate transfer type utilizing an electrophotographic process technique. That is, the image forming apparatus 1 transfers toner images of respective colors of yellow (Y), magenta (M), cyan (C), and black (K) formed on photosensitive drums 413 onto an intermediate transfer belt 421 through primary transfer such that the toner images of four colors maximum are superposed on one another on the intermediate transfer belt 421. Then, the image forming apparatus 1 forms a toner image by transferring the superposed toner image onto a paper sheet S through secondary transfer.

In addition, the image forming apparatus 1 employs a tandem system in which the photosensitive drums 413 corresponding to the four colors of Y, M, C, and K are arranged in series in the moving direction of the intermediate transfer belt 421 and toner images of the respective colors are sequentially transferred onto the intermediate transfer belt 421 through one operation.

In the present embodiment, toners of four colors of yellow (Y), magenta (M), cyan (C) and black (K) are used as toners for forming a toner image based on input image data (input image information) on the paper sheet S serving as a recording material via the intermediate transfer belt 421 serving as an image bearing member. Meanwhile, the present embodiment is configured to be capable of supplying a support (SP) toner for assisting fixation in image formation in a mode in which there is no limit to the amount of toner attached to a paper sheet. This configuration will be described later in detail.

As illustrated in FIG. 2, the image forming apparatus 1 includes an image reader 10, an operation display 20, an image processor 30, an image former 40, a sheet conveyor 50, a fixer 60, and so forth.

A controller 100 includes a central processing unit (CPU) 101, a read only memory (ROM) 102, a random access memory (RAM) 103, and so forth.

The CPU 101 reads a program corresponding to the content of processing from the ROM 102, loads the read program on the RAM 103, and dominantly controls the operation of each block of the image forming apparatus 1 in cooperation with the loaded program. At this time, various data stored on a storage 72 is referred to. The storage 72 is constituted by, for example, a nonvolatile semiconductor memory (so-called flash memory) and a hard disk drive.

The controller 100 communicates various data, via a communicator 71, with an external apparatus (for example, a personal computer) connected to a communication network such as a local area network (LAN) or a wide area network (WAN). The controller 100 receives, for example, image data (input image data) transmitted from the external apparatus, and causes the image forming apparatus 1 to form a toner image on the paper sheet S on the basis of this image data (input image data). The communicator 71 is constituted by, for example, a communication control card such as a LAN card.

The image reader 10 includes an automatic document feeding device 11 called as an auto document feeder (ADF), a document image scanning device (scanner) 12, and so forth.

The automatic document feeding device 11 sends out a document D placed on a document tray to the document image scanning device 12 by conveying the document D with a conveyance mechanism. The automatic document feeding device 11 is capable of successively reading images of a large number of documents D placed on the document tray (including images formed on both surfaces of a document D) in one time.

The document image scanning device 12 optically scans a document conveyed onto contact glass from the automatic document feeding device 11 or a document put on the contact glass, focuses light reflected from the document on a light receiving plane of a charge coupled device (CCD) sensor 12*a*, and thereby reads a document image. The image reader 10 generates input image data on the basis of the result of reading by the document image scanning device 12. The input image data is subjected to predetermined image processing by the image processor 30.

The operation display 20 is constituted by, for example, a liquid crystal display (LCD) equipped with a touch panel, and functions as a display 21 and an operator 22. The display 21 displays various operation screens, a state of an image, an operation state of each function, and the like in accordance with a display control signal input from the controller 100. The operator 22 includes various operation keys such as a numeric keypad and a start key, receives various input operations by a user, and outputs an operation signal to the controller 100.

The image processor 30 includes a circuit or the like that performs digital image processing on the input image data in accordance with initial settings or user settings. For example, the image processor 30 performs gradation correction on the basis of gradation correction data (a gradation correction table) under control of the controller 100. In addition, the image processor 30 performs various correction processing such as color correction and shading correction, compression processing, and so forth on the input image data in addition to the gradation correction. The image former 40 is controlled on the basis of the image data that has undergone these processes.

The image former 40 includes color image formation units (first toner formation units) 41Y, 41M, 41C, and 41K, an intermediate transfer unit 42, and so forth. The image formation units 41Y, 41M, 41C, and 41K form images with respective color toners of a Y component, an M component, a C component, and a K component on the basis of the input image data. In addition, the image former 40 includes a fixation assistance toner formation unit (second toner formation unit) 41SP configured to supply a support (SP) toner for assisting fixation at the time of executing a print job.

These color image formation units 41Y, 41M, 41C, and 41K and the fixation assistance toner formation unit 41SP have mutually similar configurations. For the sake of convenience of illustration and description, common constituents are denoted with the same reference letters. In the case where each constituent is distinguished, the distinction thereof is represented by adding Y, M, C, K, or SP to the reference letters. In FIG. 1, reference letters are given only to constituents of the fixation assistance toner formation unit 41SP, and reference letters for the constituents of other units 41Y, 41M, 41C, and 41K are omitted. These units 41Y, 41M, 41C, 41K, and 41SP will be hereinafter collectively referred to as toner formation units 41, and common elements thereof will be described.

A toner formation unit 41 includes an exposure device 411, a developing device 412, a photosensitive drum 413, a charging device 414, a drum cleaning device 415, and so forth.

The photosensitive drum 413 is, for example, an organic photo-conductor (OPC) of a negative-polarization type produced by sequentially forming an under coat layer (UCL), a charge generation layer (CGL), and a charge transport layer (CTL) on a peripheral surface of a conductive cylindrical body (aluminum pipe) formed from aluminum. The charge generation layer is constituted by an organic semiconductor in which a charge generation material (for example, phthalocyanine pigment) is dispersed in a resin binder (for example, polycarbonate), and generates positive charges and negative charges by being exposed to light from the exposure device 411. The charge transport layer is constituted by a material in which a hole transport material (electron-donating nitrogen-containing compound) is dispersed in a resin binder (for example, polycarbonate resin), and transports positive charges generated in the charge generation layer to the surface of the charge transport layer.

The controller 100 rotates the photosensitive drum 413 at a constant circumferential speed (for example, a linear velocity of 460 mm/sec) by controlling a driving current supplied to a driving motor (illustration omitted) configured to drive the photosensitive drum 413.

The charging device 414 uniformly charges the surface of the photosensitive drum 413 that is photoconductive to a negative polarity. The exposure device 411 is constituted by, for example, a semiconductor laser, and irradiates the photosensitive drum 413 with laser light corresponding to an image of a corresponding color component. Positive charges are generated in the charge generation layer of the photosensitive drum 413, the positive charges are transported to the surface of the charge transport layer, and thereby the surface charges (negative charges) of the photosensitive drum 413 are neutralized. On the surface of the photosensitive drum 413, an electrostatic latent image of a corresponding color component is formed due to a potential difference between the irradiated area of the photosensitive drum 413 and the surrounding area thereof.

The developing device 412 is, for example, a developing device employing a two-component development system, and forms a toner image by attaching toner of a corresponding color component to the surface of the photosensitive drum 413 to visualize the electrostatic latent image.

The drum cleaning device 415 includes a drum cleaning blade or the like that is slidably in contact with the surface of the photosensitive drum 413, and removes transfer residual toner remaining on the surface of the photosensitive drum 413 after primary transfer.

The intermediate transfer unit 42 includes the intermediate transfer belt 421, primary transfer rollers 422, a plurality of support rollers 423, a secondary transfer roller 424, a belt cleaning device 426, and so forth.

The intermediate transfer belt 421 is configured as an endless belt, and is looped over the plurality of support rollers 423. At least one of the plurality of support rollers 423 is configured as a driving roller, and the others are configured as driven rollers. For example, a roller 423A disposed downstream of a primary transfer roller 422 for the K component in the moving direction of the intermediate transfer belt 421 is preferably a driving roller. This helps keeping the moving speed of the intermediate transfer belt 421 at a primary transfer portion constant. The intermediate transfer belt 421 moves in an arrow A direction at a constant speed due to the rotation of the driving roller 423A.

The primary transfer rollers 422 are disposed on the inner circumferential surface side of the intermediate transfer belt 421 so as to oppose the photosensitive drums 413 of respective colors. The primary transfer rollers 422 are in pressure contact with the photosensitive drums 413 with the intermediate transfer belt 421 interposed therebetween, and thus primary transfer nips for transferring toner images from the photosensitive drums 413 onto the intermediate transfer belt 421 are formed.

The secondary transfer roller 424 is disposed on the outer circumferential surface side of the intermediate transfer belt 421 so as to oppose a backup roller 423B disposed downstream of the driving roller 423A in the moving direction of the intermediate transfer belt 421. The secondary transfer roller 424 is in pressure contact with the backup roller 423B with the intermediate transfer belt 421 interposed therebetween, and thus a secondary transfer nip for transferring a toner image from the intermediate transfer belt 421 onto the paper sheet S is formed.

When the intermediate transfer belt 421 passes through the primary transfer nips, the toner images on the photosensitive drums 413 are sequentially transferred onto the intermediate transfer belt 421 through primary transfer so as to be superposed on one another. More specifically, the toner images are electrostatically transferred onto the intermediate transfer belt 421 by applying a primary transfer bias to the primary transfer rollers 422 and imparting charges of a polarity opposite to the toner to the back side (side in contact with the primary transfer rollers 422) of the intermediate transfer belt 421.

Then, when the paper sheet S passes through the secondary transfer nip, the toner image on the intermediate transfer belt 421 is transferred onto the paper sheet S through secondary transfer. More specifically, the toner image is electrostatically transferred onto the paper sheet S by applying a secondary transfer bias to the secondary transfer roller 424 and imparting charges of a polarity opposite to the toner to the back side (side in contact with the secondary transfer roller 424) of the paper sheet S. The paper sheet S onto which the toner image has been transferred is conveyed toward the fixer 60.

The belt cleaning device 426 includes a belt cleaning blade or the like that is slidably in contact with the surface of the intermediate transfer belt 421, and removes transfer residual toner remaining on the surface of the intermediate transfer belt 421 after secondary transfer. Alternatively, a configuration (a so-called belt-type secondary transfer unit) in which a secondary transfer belt is looped over a plurality of support rollers including a secondary transfer roller may be employed instead of the secondary transfer roller 424.

The fixer 60 includes an upper fixer 60A, a lower fixer 60B, a heating source (not illustrated), and so forth. The upper fixer 60A includes fixing-surface-side members disposed on the side facing the surface (fixing surface) of the paper sheet S on which the toner image is formed. The lower fixer 60B includes back-surface-side support members disposed on the side facing the back surface (surface opposite to the fixing surface) of the paper sheet S. A back-surface-side support member is in pressure contact with a fixing-surface-side member, and thus a fixing nip in which the paper sheet S is nipped and conveyed is formed. The fixer 60 fixes the toner image onto the paper sheet S by heating and pressurizing, in the fixing nip, the paper sheet S onto which the toner image has been transferred through secondary transfer and which has been conveyed. The fixer 60 is disposed as a unit in a fixer F.

The fixer 60 fixes the toner image onto the paper sheet S by heating and pressurizing, in the fixing nip, the paper sheet S onto which the toner image has been transferred through secondary transfer and which has been conveyed. The fixer 60 is disposed as a unit in a fixer F. In addition, the fixer F includes an air separation unit (illustration omitted) that separates the paper sheet S from the fixing-surface-side member by blowing air thereto.

The upper fixer 60A includes an endless upper fixing belt 61, an upper heating roller 62, and an upper pressurizing roller 63 (belt heating system) serving as the fixing-surface-side members. The upper fixing belt 61 is stretched over the upper heating roller 62 and the upper pressurizing roller 63 with a predetermined belt tension (for example, 400 N). The upper fixing belt 61 and the upper pressurizing roller 63 forms a fixing nip with a lower fixing belt 64 and a lower pressurizing roller 66 that will be described later.

The lower fixer 60B has a configuration similar to the upper fixer 60A. Specifically, the lower fixer 60B includes an endless lower fixing belt 64, a lower heating roller 65, and a lower pressurizing roller 66 (belt heating system) serving as the back-surface-side support members. The lower fixing belt 64 is stretched over the lower heating roller 65 and the lower pressurizing roller 66 with a predetermined belt tension (for example, 400 N).

The upper fixing belt 61 of the upper fixer 60A comes into contact with the paper sheet S on which a toner image has been formed, and heat and fixes the toner image onto the paper sheet S at a fixing temperature (for example, 160° C. to 200° C.). Here, a fixing temperature is a temperature at which energy of an amount necessary for melting the toner on the paper sheet S can be supplied, and varies depending on the type of paper of the paper sheet S on which an image is formed and the like. The upper heating roller 62 and the lower heating roller 65 respectively heat the upper fixing belt 61 and the lower fixing belt 64. These heating rollers 62 and 65 respectively include heating sources (halogen heaters) that heat the fixing belts 61 and 64 that the heating rollers 62 and 65 stretch. The temperature of the heating sources is controlled by the controller 100. The heating rollers 62 and 65 are respectively heated by the corresponding heating sources, and, as a result, the corresponding fixing belts 61 and 64 are heated.

The upper pressurizing roller 63 is in pressure contact with the lower pressurizing roller 66 rotated by a main drive source (not illustrated) of the fixer 60 with the upper fixing belt 61 and the lower fixing belt 64 interposed therebetween. The controller 100 controls the main drive source (driving motor) and rotates the lower pressurizing roller 66 in a counterclockwise direction in FIG. 1. Drive control (for example, switching on/off, and a circumferential speed of the rotation) of the drive motor is performed by the controller 100. The heating source of the lower heating roller 65 generates heat, and thus the lower pressurizing roller 66 is heated through the lower fixing belt 64. The controller 100 controls electricity supplied to the heating source, and controls the temperature of the lower pressurizing roller 66 to a predetermined temperature (for example, 80° C. to 120° C.).

The lower pressurizing roller 66 is in pressure contact with the upper pressurizing roller 63 via the upper fixing belt 61 and the lower fixing belt 64 with a predetermined fixing load (for example, 2650 N). In this way, a fixing nip in which the paper sheet S is nipped and conveyed is formed between the upper fixing belt 61 and the upper pressurizing roller 63 and the lower fixing belt 64 and the lower pressurizing roller 66. When the lower pressurizing roller 66 rotates, the fixing belt 61 is rotationally driven in a clockwise direction. In accordance with this, the upper pressurizing roller 63 is rotationally driven in the clockwise direction.

The sheet conveyor 50 includes a sheet feeding portion 51, a sheet discharge portion 52, a conveyance path portion 53, and so forth. Three sheet feeding tray units 51*a* to 51*c* constituting the sheet feeding portion 51 accommodate paper sheets S (standard paper sheets and non-standard paper sheets) identified on the basis of grammage, size, and the like and divided into preset types. The conveyance path portion 53 includes a plurality of conveyance roller pairs such as a registration roller pair 53*a*.

The paper sheets S accommodated in the sheet feeding tray units 51*a* to 51*c* are fed one by one from the topmost part thereof, and conveyed to the image former 40 by the conveyance path portion 53. At this time, the skew of the fed paper sheet S is corrected and the timing of conveyance is adjusted by a registration roller portion including the registration roller pair 53*a*. Then, in the image former 40, the toner image on the intermediate transfer belt 421 is collectively transferred onto one surface of the paper sheet S through secondary transfer, and a fixing process is performed in the fixer 60. The paper sheet S on which an image has been formed is discharged to the outside of the apparatus by the sheet discharge portion 52 including sheet discharge rollers 52*a*.

In the case of performing color printing by using such an image forming apparatus of an electrophotographic system, the processing of under color removal (UCR) described above is sometimes performed to ensure the productivity and conserve energy. In this case, a limit is set to the amount of toner, and image formation is controlled such that a gray component in which toners of Y, M, and C are superposed on one another is replaced by K toner for shading. According to such control, the amount of toner consumption can be suppressed without changing a general color space by, for example, performing the processing of UCR such that toners of Y, M, and C are each deposited by an amount of 80%, that is, 240% in total, and a small amount of K toner is deposited in the case of depositing each of toners of Y, M, and C by an amount of 100%, that is, 300% in total.

However, there has been a problem that, in the case where the processing of UCR is performed, reproducibility of image, fineness of image, and a feel of depth and three-dimensionality of black regions and shadow portions decrease, and particularly reproducibility of shadow portions is prominently degraded. That is, in the case of performing a UCR process, an image that can be originally expressed by the three primary colors of Y, M, and C is expressed by additionally using K, and thus there is a problem that the depth of a black color and fineness of an image in a black background decrease when, for example, outputting a photographic image on a paper sheet.

Therefore, there has been a problem that processing of UCR cannot meet a demand from a user in the case where high color reproducibility is demanded, for example, in the case of printing a photographic image.

Therefore, in the present embodiment, processing of supplying, by an amount corresponding to the amount of toners superposed on a paper sheet, the fixation assistance toner SP serving as an assistance toner that assists melting of toners superposed on the paper sheet is performed.

Here, it is desirable that a high-thermal-conductivity toner having a higher thermal conductivity than the toners (hereinafter also simply referred to as color toners) for forming the toner image based on the input image data is used as the fixation assistance toner SP in order to assist the melting of toners of Y, M, C, and K, and ensuring or improving the fixability. Such a high-thermal conductivity toner can be realized by, for example, containing a metal-based pigment.

In the present embodiment, the fixation assistance toner SP is configured as a black high-thermal-conductivity toner containing a metal-based pigment, a binder resin, a fixation releasing agent, and a charge control agent. Here, magnetite can be used as the metal-based pigment.

In the case where the metal-based pigment is contained as a component of the fixation assistance toner SP, the content (ratio) of the metal-based pigment is desirably 20% by weight or more. In the case where the content of the metal-based pigment is less than 20% by weight, the effect of assisting melting and fixation of color toners is reduced, and the fixability decreases.

Although the upper limit of the content (ratio) of the metal-based pigment varies depending on the color of the fixation assistance toner SP and the position of the fixation assistance toner SP applied on a paper sheet, in the present embodiment, the upper limit is desirably 50% by weight or less. In the case where the content of the metal-based pigment exceeds 50% by weight, dullness of the image becomes visually obvious.

By employing the configuration described above, the thermal conductivity of the fixation assistance toner SP can be raised to about 1.3 W/mK to 3.2 W/mK in the case where the thermal conductivity of the color toners is about 0.15 W/mK.

Control performed in the image forming apparatus 1 of the present embodiment when executing a print job will be described below. The controller 100 calculates, from the input image data, the amount (hereinafter also simply referred to as the amount of toner) of supplied or attached color toners (Y, M, C, and K) for input images superposed on the paper sheet S, and controls the image former 40 to supply the fixation assistance toner SP of an amount corresponding to the calculated amount of toner.

Figure 3:
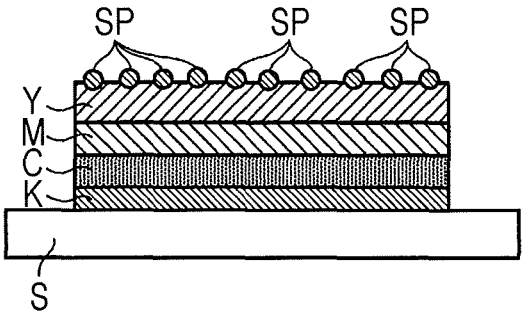
FIG. 3 is a diagram for describing an image forming method in the image forming apparatus of the embodiment, and is a side view of toner layers schematically illustrating a state in which a fixation assistance toner is attached onto toner layers of Y, M, C, and K.

FIG. 3 schematically illustrates a state in which the fixation assistance toner SP is supplied in the case where such control is performed. FIG. 3 illustrates a state in which toners of K, C, M, and Y are deposited on the paper sheet S in this order from the bottom to the top, and the black fixation assistance toner SP is attached onto the topmost layer of Y toner.

Figure 4A:
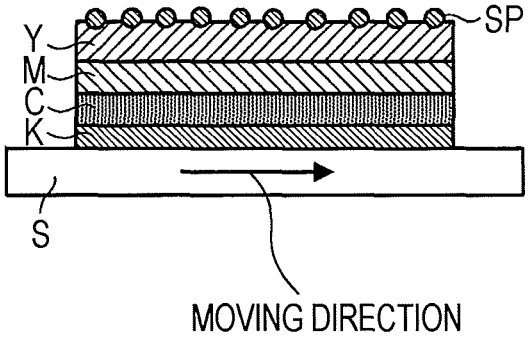
FIGS. 4A and 4B are diagrams for describing the image forming method in the image forming apparatus of the embodiment, and respectively illustrate a state of a paper sheet onto which the fixation assistance toner has been supplied and a state in which the paper sheet onto which the fixation assistance toner has been supplied is passing through a fixer.

In the present embodiment, the fixation assistance toner formation unit 41SP is disposed on the most upstream side in the rotation direction of the intermediate transfer belt 421, and thus the fixation assistance toner SP, Y toner, M toner, C toner, and K toner are superposed through primary transfer on the intermediate transfer belt 421 in this order from the bottom to the top. Then, the toners transferred onto the intermediate transfer belt 421 through primary transfer are transferred onto the paper sheet S passing through the secondary transfer nip through secondary transfer, and thus the paper sheet S on which the black fixation assistance toner SP is attached onto the topmost layer of Y toner of the color toner layers is conveyed to the fixer 60 as illustrated in FIG. 4A.

Figure 4B:
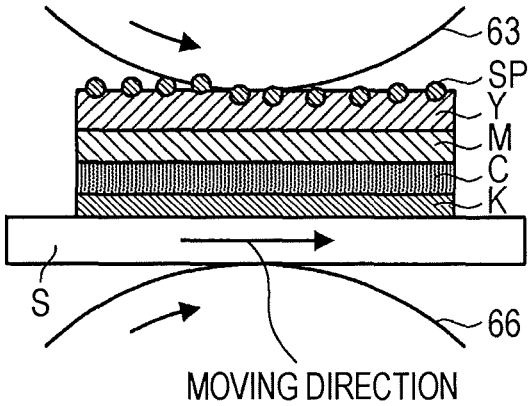

As illustrated in FIG. 4B, the paper sheet S is subjected to heat and pressure from the fixing nip formed by the fixing-surface-side members (the upper pressurizing roller 63 and so forth) and the back-surface-side support members (the lower pressurizing roller 66 and so forth) heated to a predetermined temperature when passing through the fixer 60. At this time, heat from the fixer 60 is accumulated in the fixation assistance toner (high-thermal-conductivity toner) SP (see FIG. 5), and thus toner in the vicinity of the fixation assistance toner SP becomes more likely to be melted and thereby melting of color toners having relatively low thermal conductivity is assisted. That is, more heat is transmitted to color toners from the fixer 60 through the high-thermal-conductivity toner, the color toners become more likely to be melted, and thus adhesion thereof to a paper sheet is improved. Therefore, according to the present embodiment, the fixability of color toners can be improved.

In addition, in the present embodiment, the fixation assistance toner SP having a high thermal conductivity is supplied to the topmost part of the color toner layers that is closer to the heat source, and thus heat supplied from the fixer 60 is transmitted to color toners through the fixation assistance toner SP while suppressing loss of the heat from the fixer 60 as much as possible and melting of the color toners is thereby assisted.

In addition, according to the present embodiment, there is no need to decrease the sheet conveyance speed or raise the fixing temperature even in the case where the amount of toner is large, and thus the demand for energy conservation can be met while retaining the productivity and improving the fixability of color toners.

In addition, according to the present embodiment, there is no need to perform the processing of UCR described above for reducing the total amount of toner in the case where the amount of toner is large, and thus the depth and fineness of an image can be reproduced with a high precision even in the case where a high color reproducibility is required, for example, when performing full-color printing of an image such as a photograph of scenery or face.

As described above, according to the present embodiment, a toner image can be fixed with a small energy consumption while retaining the productivity and image quality.

Figure 5:
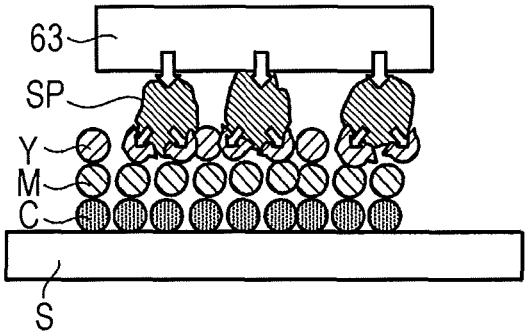
FIG. 5 schematically illustrates how heat from the fixer is transmitted to color toners through a high-thermal-conductivity toner.

Although FIG. 5 schematically illustrates an exemplary case where the particle diameter of the fixation assistance toner SP is larger than the particle diameter of the color toners of Y, M, and C, the size relationship between the particle diameters is not particularly limited to this.

The amount of supply of the fixation assistance toner SP per unit area is preferably set to 0.05 $g/m^2$ or larger from the viewpoint of ensuring the fixability of color toners.

The upper limit of the amount of supply of the fixation assistance toner SP per unit area is not particularly limited, and may be changed appropriately in accordance with the color, use, and the like. However, in the case where a configuration in which the fixation assistance toner SP is black and is applied on the topmost layer of a toner image formed on a paper sheet is employed as in the present embodiment, dullness of the image becomes visually obvious when the amount of supply of the fixation assistance toner SP becomes larger. Therefore, in the present embodiment, the amount of supply of the fixation assistance toner SP per unit area is preferably 0.08 $g/m^2$ or less.

Figure 6:
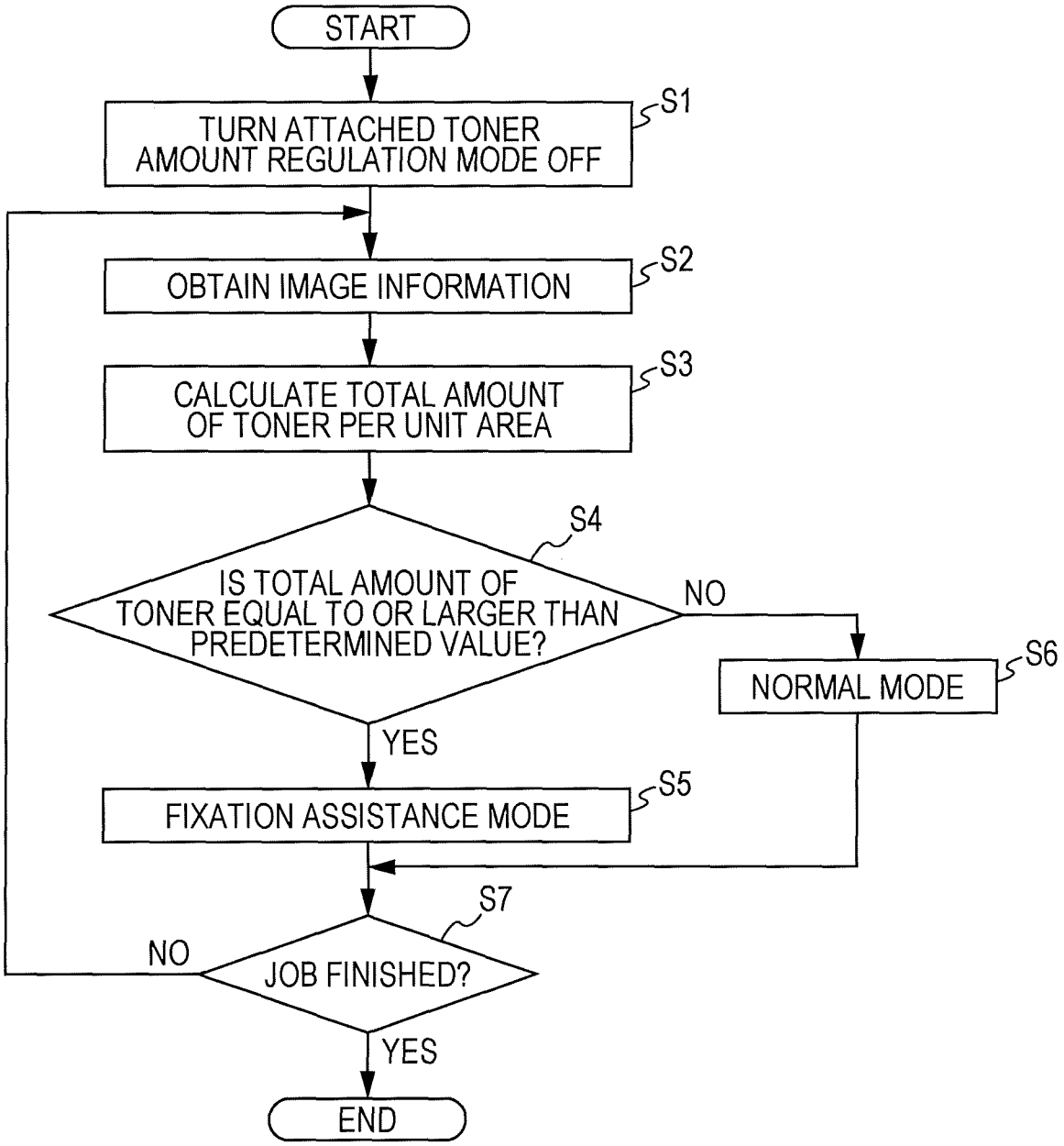
FIG. 6 is an example of a control flowchart of image formation performed by the image forming apparatus of the embodiment.

An example of the control performed by the controller 100 at the time of executing a print job will be described with reference to a flowchart of FIG. 6.

In step S1, the controller 100 refers to an operation signal input through an operation by a user, and turns an attached toner amount regulation mode off in a certain case. For example, in the case where the operation signal indicates setting of performing full-color printing of a photographic image, the controller 100 turns the attached toner amount regulation mode off. In the present embodiment, the processing of UCR described above is not performed in the case where the attached toner amount regulation mode is off.

Next, in step S2, the controller 100 obtains input image data to be printed on one paper sheet S, and the process proceeds to step S3. In step S3, the controller 100 analyzes the obtained input image data, and calculates the amount of application of toner to be superposed on the paper sheet S for each unit region. Here, a unit region is one region among n regions into which the whole image formation region is divided by unit area.

Next, in step S4, the controller 100 determines whether or not there is a region in which the calculated amount of application of toner is equal to or larger than a threshold value. In the present embodiment, a default value related to the threshold value is set to 240%. The value of 240% corresponds to the amount of application of toner that is eight tenths of the maximum amount of application of toner when the maximum amount of application of toner is 300% in the case where the toners of Y, M, and C are each applied on the paper sheet S by the maximum amount (100%).

To be noted, the value related to the threshold value of step S4 may be configured to be changeable by an operation on the operation display 20.

In the case where it is determined that there is a region in which the calculated amount of application of toner is 240% or larger (step S4, Yes), the process proceeds to step S5, and the controller 100 controls image formation in a fixation assistance mode in which a fixation assistance toner is supplied. In contrast, in the case where it is determined that there is no region in which the calculated amount of application of toner is 240% or larger (step S4, No), the process proceeds to step S6, and the controller 100 controls image formation in a normal mode in which the fixation assistance toner is not supplied.

In step S5 corresponding to the fixation assistance mode, the controller 100 controls the image former 40 such that a high-thermal-conductivity toner is applied on a region on the paper sheet S corresponding to the region in which the amount of application of toner exceeds the threshold. More specifically, the controller 100 controls the toner formation units 41 such that the high-thermal conductivity toner and then three or more kinds of toners among toners of Y, M, C, and K are applied on a region on the intermediate transfer belt 421 corresponding to the region on the paper sheet S in which the amount of application of toner exceeds the threshold.

In addition, in step S5, the controller 100 controls the toner formation units 41 such that three or more kinds of toners among toners of Y, M, C, and K are applied on the other region, that is, a region on the intermediate transfer belt 421 corresponding to a region on the paper sheet S in which the amount of application of toner is equal to or smaller than the threshold without applying the high-thermal-conductivity toner.

Figure 7:
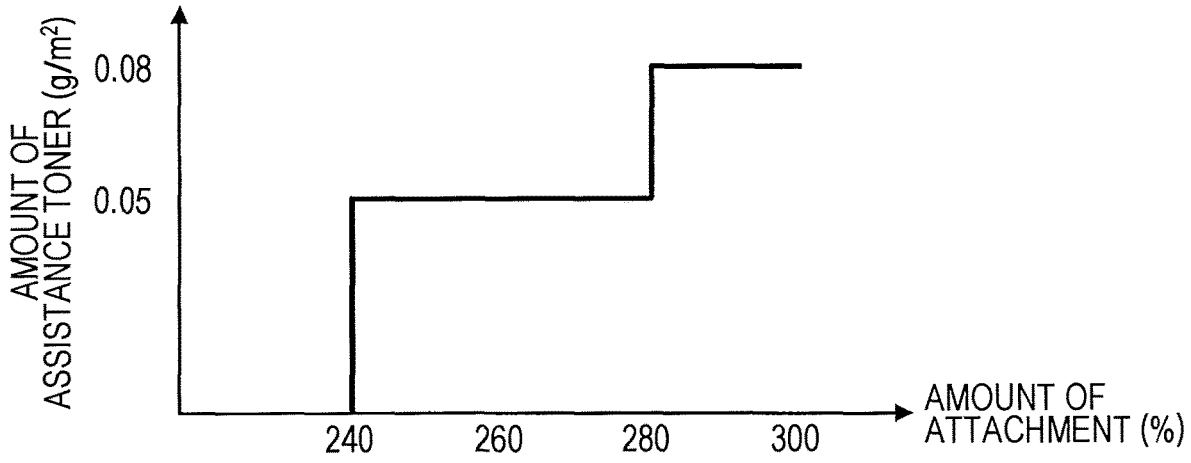
FIG. 7 is a diagram for describing control of the amount of supply of the high-thermal-conductivity toner in image formation performed by the image forming apparatus of the embodiment.

FIG. 7 illustrates an example of control of the amount of application of toner in the case of applying a high-thermal-conductivity toner. In FIG. 7, the horizontal axis corresponds to the amount of attachment of color toners, and the vertical axis corresponds to the amount of supply of the fixation assistance toner. In this example, two values of 240% and 280% are set as values related to the threshold value of the amount of application of toner, and it is configured that the amount of application of high-thermal-conductivity toner is increased when the amount of attachment of color toners is larger.

That is, in the fixation assistance mode of step S5, the controller 100 determines that image regions on the intermediate transfer belt 421 and the paper sheet S in which the amount of attachment of toner is smaller than 240% does not need application of the high-thermal-conductivity toner, and thus controls the toner formation units 41 such that only color toners are supplied to the image regions. In addition, the controller 100 controls the toner formation units 41 such that the high-thermal-conductivity toner is applied, by an amount of 0.05 g/m$^2$, on image regions on the intermediate transfer belt 421 and the paper sheet S in which the amount of attachment of toner is equal to or larger than 240% and smaller than 280%. Further, the controller 100 controls the toner formation units 41 such that the high-thermal-conductivity toner is applied, by an amount of 0.08 g/m$^2$, on image regions on the intermediate transfer belt 421 and the paper sheet S in which the amount of attachment of toner is equal to or larger than 280%.

As another example of control of the amount of application of high-thermal-conductivity toner, in the case where the amount of application of toner exceeds 240%, the amount of application of high-thermal-conductivity toner per unit area may be increased proportionally to the amount of excess.

In step S6 corresponding to the normal mode, the controller 100 controls the toner formation units 41 such that one or more kinds of toners among toners of Y, M, C, and K are applied on the whole region on the intermediate transfer belt 421 corresponding to a region on the paper sheet S in which toner is to be applied without applying the high-thermal-conductivity toner.

In step S7 after step S5 or step S6, the controller 100 determines whether the print job has been finished. In the case where it is determined that the print job has been finished (step S7, Yes), the controller 100 finishes the series of processes described above. In contrast, in the case where it is determined that the print job has not been finished (step S7, No), the process returns to step S2, and the controller 100 continues the control related to image formation of step S2 and subsequent steps on a paper sheet S to be subjected to printing next.

By controlling image formation as described above by using the controller 100, the amount of consumption of high-thermal-conductivity toner can be suppressed, and an image of a high color reproducibility having a feel of depth and three-dimensionality can be output onto a paper sheet S without raising the fixing temperature in a subsequent fixing process or decreasing the sheet conveyance speed.

In the embodiment described above, a black (K) toner has been used as an exemplary high-thermal-conductivity toner that assists melting of color toners. However, the high-thermal-conductivity toner may have a color different from black.

For example, in the case of a cyan (C) toner, the thermal conductivity can be raised by containing a metal-based pigment such as cobalt and copper oxide in a component thereof. In addition, in the case of a magenta (M) toner, the thermal conductivity can be raised by containing a metal-based pigment such as red iron oxide in a component thereof. In addition, in the case of a yellow (Y) toner, the thermal conductivity can be raised by containing a metal-based pigment such as yellow iron oxide in a component thereof. In addition, in the case of a white toner, the thermal conductivity can be raised by containing a metal-based pigment such as titanium oxide (TiO) in a component thereof. The various pigments described above may be used individually or in combination.

However, in the case where it is desired that an image having a feel of depth and three-dimensionality is output on a paper sheet S, for example, when printing a photographic image, the fixation assistance toner is preferably black or of a dark color close to black.

In the embodiment described above, the unit (second toner formation unit) that supplies the fixation assistance toner is disposed upstream of the units that supply the color toners of Y, M, C, and K in the rotation direction of the intermediate transfer belt 421 such that the fixation assistance toner is applied on the topmost layer of the toner image formed on the paper sheet S. However, the unit that supplies the fixation assistance toner may be disposed, for example, between the unit that supplies Y toner and the unit that supplies M toner.

In addition, although one unit (second toner formation unit) that supplies the fixation assistance toner is provided in the embodiment described above, such a unit may be provided in a plural number.

In addition, as another exemplary configuration, a configuration in which the fixation assistance toner (yellow toner containing, for example, yellow iron oxide) is supplied from a color image formation unit 41 for forming the image based on the input image data, for example, from the color image formation unit 41Y that supplies Y toner to be applied as the topmost layer on the paper sheet S may be employed.

However, the high-thermal-conductivity toner containing such a metal-based pigment as described above tends to be inferior to a normal color toner in terms of tone. Therefore, from the viewpoint of improving the color reproducibility as much as possible, it is preferable that the dedicated fixation assistance toner formation unit 41SP is provided separately from the color image formation units 41 for forming the image based on the input image data and the fixation assistance toner is supplied as necessary as in the present embodiment.

EXAMPLES

Examples (Examples 1 and 2) of application of the present invention will be described below. The present inventors carried out tests of color reproducibility and toner fixability by using the image forming apparatus 1 having the configuration of the embodiment described above.

As conditions common to Examples and Comparative Example below, in the image forming apparatus, linear velocities of photosensitive drums were set to 460 mm/sec, the heating temperature of the upper fixing belt was set to 168° C., and the heating temperature of the lower fixing belt was set to 80° C. In addition, in each Example, a black high-thermal-conductivity toner containing a magnetite pigment was used as the fixation assistance toner.

Example 1

In Example 1, as control of image formation, printing was performed by supplying the high-thermal-conductivity toner for fixation assistance by an amount of 0.05 g/m$^2$ to each of YMC images respectively including toners of amounts of 240%, 250%, 260%, and 270% in total. In addition, printing was performed by supplying the high-thermal-conductivity toner (black) for fixation assistance described above by an amount of 0.08 g/m$^2$ to each of YMC images respectively including toners of amounts of 280%, 290%, and 300% in total, and tests of color reproducibility and toner fixability were performed on each printed product.

In addition, as Comparative Example to be compared with these, tests were performed in the same conditions except that the fixation assistance toner was not applied.

Assessment of color reproducibility was performed by visual observation, "Good" was given to cases where no dullness was recognized in the printed image, and "Bad" was given to cases where dullness was recognized.

For assessment of toner fixability, test was carried out by rubbing a clean paper sheet (white paper sheet) against the printed surface of the paper sheet on which an image had been printed, and the degree of dirtiness of the white paper sheet after the test was assessed. Specifically, a value indicating the dirtiness of the paper sheet was calculated in accordance with the following mathematical formula (1).

$$\text{Dirtiness } \Delta L \text{ of paper sheet} = \text{Brightness } L \text{ of paper sheet after test} - \text{Brightness } L \text{ of paper sheet before test} \quad \text{(Mathematical formula (1))}$$

As a result of the calculation performed in accordance with the mathematical formula (1), "Good" indicating a level of no dirtiness was given to cases where ΔL was smaller than 0.5, "Fair" indicating a practically acceptable level of dirtiness was given to a case where ΔL was equal to or larger than 0.5 and smaller than 1.5, and "Bad" indicating an unacceptable level of dirtiness was given to cases where ΔL was equal to or larger than 1.5.

Results of experiments on Example 1 and Comparative Example are shown in Table 1.

TABLE 1

| | Comparative Example (no assistance toner) | | Example 1 (with assistance toner) | | |
|---|---|---|---|---|---|
| Amount of attachment (%) | Color reproducibility | Fixability | Amount of supply of assistance toner (g/m$^2$) | Color reproducibility | Fixability |
| 240 | Good | Good | 0.05 | Good | Good |
| 250 | Good | Fair | 0.05 | Good | Good |
| 260 | Good | Bad | 0.05 | Good | Good |
| 270 | Good | Bad | 0.05 | Good | Good |
| 280 | Good | Bad | 0.08 | Good | Good |
| 290 | Good | Bad | 0.08 | Good | Good |
| 300 | Good | Bad | 0.08 | Good | Good |

As shown in Table 1, in Example 1, the color reproducibility and fixability were good in all cases. In contrast, in Comparative Example in which the fixation assistance toner was not applied, although the color reproducibility and fixability were good in the case where the total amount of toner was 240%, the fixability was degraded when the total amount of toner increased to 250%, and unacceptable dirtiness occurred when the total amount of toner increased to 260% or larger.

Example 2

In Example 2, six kinds of fixation assistance black toners in which the content of the magnetite pigment was set to various values, specifically 18% by weight, 20% by weight, 26% by weight, 42% by weight, 50% by weight, and 52% by weight were prepared, and experiments were carried out in the same settings of control as Example 1.

That is, in Example 2, as control of image formation, printing was performed by supplying the fixation assistance black toner described above by an amount of 0.05 g/m$^2$ to each of YMC images respectively including toners of amounts of 240%, 250%, 260%, and 270% in total. In addition, printing was performed by supplying the fixation assistance black toner described above by an amount of 0.08 g/m$^2$ to each of YMC images respectively including toners of amounts of 280%, 290%, and 300% in total, and tests of color reproducibility and toner fixability were performed on each printed product. Assessment of color reproducibility and toner fixability was performed in the same manner as Example 1.

Results of experiments on Example 2 are shown in Table 2.

TABLE 2

| Content of pigment (wt %) | Color reproducibility | Fixability |
|---|---|---|
| 18 | Good | Fair |
| 20 | Good | Good |
| 26 | Good | Good |
| 42 | Good | Good |
| 50 | Good | Good |
| 52 | Fair | Good |

As shown in Table 2, when the content of the magnetite pigment was in the range of 20% to 50% by weight, the color reproducibility and fixability were good in all cases. To be noted, in the case where the content of the magnetite pigment was set to 18% by weight, although at an acceptable level in terms of fixability, slight dirtiness occurred. In contrast, in the case where the content of the magnetite pigment was set to 52% by weight, although at an acceptable level in terms of color reproducibility, slight dullness occurred.

As described above, according to the image forming apparatus and the image forming method to which the present invention is applied, an image forming apparatus and an image forming method that are capable of fixing a toner image with a small energy consumption while retaining the productivity and image quality can be provided.

Although embodiments of the present invention have been described and illustrated in detail, it is clearly understood that the same is by way of illustration and example only and not limitation, the scope of the present invention should be interpreted by terms of the appended claims. That is, the present invention can be implemented in various forms without deviating from the summary or the primary features thereof.

What is claimed is:

1. An image forming apparatus comprising:

an image former that forms a toner image based on input image information by superposing toners of plural colors on a recording material;

a fixer that fixes the toner image formed on the recording material;

a toner amount calculator that calculates, from the input image information, an amount of toners, other than an assistance toner to be supplied onto a topmost layer of the toner image, to be superposed on the recording material to form the toner image; and a hardware processor configured to:

determine, based on whether or not the calculated amount of toners exceeds a threshold value, whether or not, without reducing any toner to be supplied under the topmost layer, the assistance toner is to be supplied onto the topmost layer, the assistance toner being a high-thermal-conductivity toner that has a higher thermal conductivity than the toners used for forming the toner image based on the input image information, and when it is determined that the calculated amount of toners exceeds the threshold value, control the image former to supply the assistance toner onto the topmost layer of the toner image formed on the recording material based on the input image information by an amount corresponding to the calculated amount of toners, wherein, when it is determined that the calculated amount of toners does not exceed the threshold value, the image former is not controlled to supply the assistance toner onto the topmost layer of the toner image formed on the recording material based on the input image information by the amount corresponding to the calculated amount of toners.

2. The image forming apparatus according to claim 1, wherein the toner amount calculator calculates the amount of toners to be superposed on the recording material for each of unit regions, and the hardware processor determines, for each of the unit regions, whether the assistance toner is to be supplied on a basis of whether the amount of toners to be superposed on the recording material for the respective unit region exceeds the threshold value, and controls the image former such that the assistance toner is supplied to a unit region to which the assistance toner has been determined to be supplied.

3. The image forming apparatus according to claim 1, wherein the hardware processor controls the image former such that the amount of supply of the assistance toner is larger in a case where the amount of toners calculated by the toner amount calculator is larger.

4. The image forming apparatus according to claim 1, wherein the image former includes a first toner formation unit that forms the toner image based on the input image information, and a second toner formation unit that forms a toner image constituted by the assistance toner.

5. The image forming apparatus according to claim 4, wherein the second toner formation unit is provided at such a position as to supply the assistance toner onto the topmost layer of the toner image formed on the recording material.

6. The image forming apparatus according to claim 1, wherein the high-thermal-conductivity toner contains a metal-based pigment in an amount of 20% to 50% by weight.

7. The image forming apparatus according to claim 6, wherein the high-thermal-conductivity toner contains the metal-based pigment, a binder resin, a fixation releasing agent, and a charge control agent.

8. The image forming apparatus according to claim 6, wherein the high-thermal-conductivity toner has a thermal conductivity equal to or higher than 1.5 W/mK.

9. The image forming apparatus according to claim 1, wherein the hardware processor controls the image former such that the assistance toner is supplied in a mode in which there is no limit to an amount of toners attached onto the recording material.

10. The image forming apparatus according to claim 1, wherein the image former includes an intermediate transfer belt for transferring toners onto the recording material, and the hardware processor controls the image former such that the assistance toner is supplied onto the recording material via the intermediate transfer belt.

11. A non-transitory recording medium storing a computer readable program in an image forming apparatus that forms a toner image based on input image information by superposing toners of plural colors on a recording material, the program causing a computer to perform:

calculating, from the input image information, an amount of toners, other than an assistance toner to be supplied onto a topmost layer of the toner image, to be superposed on the recording material to form the toner image;

determine, based on whether or not the calculated amount of toners exceeds a threshold value, whether or not, without reducing any toner to be supplied under the topmost layer, the assistance toner is to be supplied onto the topmost layer, the assistance toner being a high-thermal-conductivity toner that has a higher thermal conductivity than the toners used for forming the toner image based on the input image information; and controlling the image forming apparatus to, when it is determined that the calculated amount of toners exceeds the threshold value, supply the assistance toner onto the topmost layer of the toner image formed on the recording material based on the input image information by an amount corresponding to the calculated amount of toners, and to fix the toner image and the assistance toner supplied onto the recording material, wherein, when it is determined that the calculated amount of toners does not exceed the threshold value, the image forming apparatus is not controlled to supply the assistance toner onto the topmost layer of the toner image formed on the recording material based on the input image information by the amount corresponding to the calculated amount of toners.

12. The non-transitory recording medium storing a computer readable program according to claim 11, wherein, in the calculation of the amount of toners, the amount of toners to be superposed on the recording material is calculated for each of unit regions, and in the supplying of the assistance toner, whether the assistance toner is to be supplied is determined for each of the unit regions on a basis of whether the amount of toners to be superposed on the recording material for the respective unit region exceeds the threshold value, and the assistance toner is supplied to a unit region to which the assistance toner has been determined to be supplied.

13. The non-transitory recording medium storing a computer readable program according to claim 11, wherein, in the supplying of the assistance toner, the amount of supply of the assistance toner is larger in a case where the amount of toners calculated by the toner amount calculator is larger.

* * * * *